United States Patent [19]

Behr et al.

[11] Patent Number: 4,955,960

[45] Date of Patent: Sep. 11, 1990

[54] APPARATUS FOR COATING WORKPIECES ELECTROSTATICALLY

[75] Inventors: Hans Behr, Stuttgart; Kurt Vetter, Remseck; Rolf Schneider, Burgstetten; Fred Luderer, Leutenbach, all of Fed. Rep. of Germany

[73] Assignee: Behr Industrieanlagen GmbH & Co., Fed. Rep. of Germany

[21] Appl. No.: 411,223

[22] Filed: Sep. 22, 1989

Related U.S. Application Data

[63] Continuation of Ser. No. 166,193, Mar. 10, 1988, abandoned.

[30] Foreign Application Priority Data

Mar. 23, 1987 [DE] Fed. Rep. of Germany ..... 3709508
Jul. 20, 1987 [DE] Fed. Rep. of Germany ... 8709948[U]

[51] Int. Cl.[5] ..... B05B 5/04

[52] U.S. Cl. ..... 239/3; 239/105; 239/703

[58] Field of Search ..... 239/105, 223, 324, 703, 239/706, 707, 700, 3

[56] References Cited

U.S. PATENT DOCUMENTS

| | | | |
|---|---|---|---|
| 2,890,388 | 6/1959 | Croskey . | |
| 3,051,394 | 8/1962 | Sedlacsik | 239/703 X |
| 3,075,706 | 1/1963 | Point | 239/700 |
| 3,393,662 | 7/1968 | Blackwell . | |
| 3,408,985 | 11/1968 | Sedlacsik . | |
| 3,843,054 | 10/1974 | Kendall et al. | 239/708 |
| 3,870,232 | 3/1975 | Zarchia | 239/696 |
| 3,952,951 | 4/1976 | Raetz et al. | 239/105 X |
| 4,143,819 | 3/1979 | Hastings | 239/707 |
| 4,171,100 | 10/1979 | Benedek et al. | 239/703 X |
| 4,238,077 | 12/1980 | Asahi-Okuma . | |
| 4,760,965 | 8/1988 | Schneider | 239/703 X |
| 4,771,949 | 9/1988 | Behr et al. . | |

FOREIGN PATENT DOCUMENTS

| | | |
|---|---|---|
| 3609240 | 9/1987 | Fed. Rep. of Germany . |
| 126675 | 3/1977 | German Democratic Rep. . |
| 901969 | 7/1962 | United Kingdom . |

*Primary Examiner*—Andres Kashnikow
*Assistant Examiner*—Kevin P. Weldon
*Attorney, Agent, or Firm*—Reising, Ethington, Barnard, Perry & Milton

[57] ABSTRACT

Particles of conductive coating material, such as the water-enamel type paint, are sprayed from a grounded bell-atomizer (2) and are electrostatically charged in the corona-discharge area by outer electrodes (10) which are inserted into a holding-arrangement (11, 12, 15) made of an insulating material. Potential-controls in the form of suitably selected materials for the holding-arrangement (11, 12, 15) and/or an atomizer-housing (4) are provided. The radial-potential pattern between the atomizer-housing (4, 6) and the outer electrodes (10) is approximated to the radial-potential distribution of the material sprayed. The insulating material of at least a portion of the apparatus consists of a fluorocarbon such as PTFE (polytetrafluorethylene). The subject invention reduces the danger of the apparatus coating itself.

15 Claims, 2 Drawing Sheets

APPARATUS FOR COATING WORKPIECES ELECTROSTATICALLY

This application is a continuation, division, of application Ser. No. 166,193, filed Mar. 10, 1988 now abandoned.

TECHNICAL FIELD

The invention relates to an apparatus for coating workpieces electrostatically.

BACKGROUND ART

An apparatus for coating motor-vehicle bodies wherein an arrangement of external electrodes carries a high-voltage potential is known to have substantial advantages when used with conductive spraying materials such as so-called water-enamels. Examples of such are shown in the prior art German OS 34 29 075 and 36 09 240. The external electrode arrangement is advantageous in overcoming insulating problems, since the entire paint-line system as far as the spraying head can be grounded The prior art external electrode arrangement teachings, however, have one major draw-back in that it is extremely difficult to prevent contamination of the spraying device, especially in the vicinity of the electrodes, the electrode-holding arrangement and the atomizer-housing, with the coating material Contamination of the electrode-area results in a drop in output, i.e. reduced efficiency and this, in turn, increases the tendency towards still heavier contamination by the sprayed material For this reason, the prior art apparatus disclosed in German OS 34 29 075 has only two, three or, at the most, four charging electrodes, each of which is embedded in a plastic holder extending radially from the external housing of the spraying head and axially towards the workpiece to be coated. The rear end of each of these electrode holders are secured to an annular element located upon the external housing of the spraying head and also made of plastic. In contradistinction, the apparatus described in the prior art German OS 36 09 240 comprises an annular element surrounding the external housing of the spraying head and made of an insulating material from which several needle-shaped electrodes, if necessary carried in finger-like extensions, project. An electrical conductor, connecting the circle of electrodes together, is connected to a high-voltage line and is insulated. This provides a spray-pattern which is more uniformly charged than when only three or four individual electrodes are used. Although these circular electrode designs have been found satisfactory in practice, they are found deficient in that they fail to overcome contamination about the electrode area. Experience has shown that a larger amount of sprayed paint-particles can be deposited upon the insulated surfaces of the electrodes, upon the spoke-like supports carrying the electrode-arrangement, and upon the atomizer housing, instead of being deposited upon the workpiece to be coated.

SUMMARY OF THE INVENTION AND ADVANTAGES

The subject invention comprises an apparatus or electrostatically coating workpieces with an electrically conductive coating material The apparatus comprises a spraying device having a rotary atomizer, an external housing fabricated from an insulating material, and an internal housing disposed within the external housing.

The rotary atomizer includes a spraying head extending from the internal housing. A supply line conducts the coating material from a storage system to the spraying head. The supply line and the spraying head are at ground potential. Needle-shaped charging electrodes having exposed front ends are distributed radially about the spraying head and are connected to a high voltage supply for charging the coating material and producing an electric field An electrode-holding arrangement is made of an insulating material for encasing the charging electrodes. The electrode-holding arrangement includes at least one support extending from the external housing. The apparatus is characterized by including potential control means for approximating the radial potential pattern between the internal housing and the charging electrodes to the radial distribution of the coating material sprayed.

The subject invention provides an apparatus which reduces the possibility of coating material contamination about the atomizer housing and the charging electrodes

BRIEF DESCRIPTION OF THE DRAWINGS

The invention is explained hereinafter in greater detail in conjunction with the preferred example of a rotary atomizer with external electrodes illustrated in the drawing attached hereto, wherein.

DETAILED DESCRIPTION OF THE PREFERRED EMBODIMENT

In the case of an apparatus of the type having electrode-tips or edges arranged concentrically around the spraying edge and preferably set back slightly behind the plane thereof, the coating material is atomized in known fashion and is sprayed with a predominantly radial component of movement. In contrast to conventional contact-charging of the material, or to an atomizer carrying a high-voltage potential, the sprayed particles of the subject invention are not initially charged. Instead, the atomized paint particles receive their charge at a radial distance from the spraying edge, i.e., where the air in the vicinity of the electrodes is charged adjacent the corona-discharge. After the atomizer paint-particles are charged indirectly by air-ion-agglomeration, the paint-particles are attracted to the grounded workpiece to be coated. The danger of the apparatus coating itself in the area of the electrodes can be substantially reduced by using appropriate insulating materials or a combination of different insulating materials thereabout.

According to a first aspect of the subject invention, a radial potential control can be achieved which takes into account the charging of ionizing area of the external electrodes at a corresponding radial distance from the spraying edge.

According to a second aspect of the subject invention, the use of fluorocarbons, and preferably polytetrafluorethylene (PTFE), as the insulating material makes it possible to substantially reduce self-contamination of the unit while in operation. The contamination is considerably less than with any of the synthetic materials hitherto used in practice, for example polypropylene (PP) or polyacetate (POM - polyoxymethylene).

Figure 1:
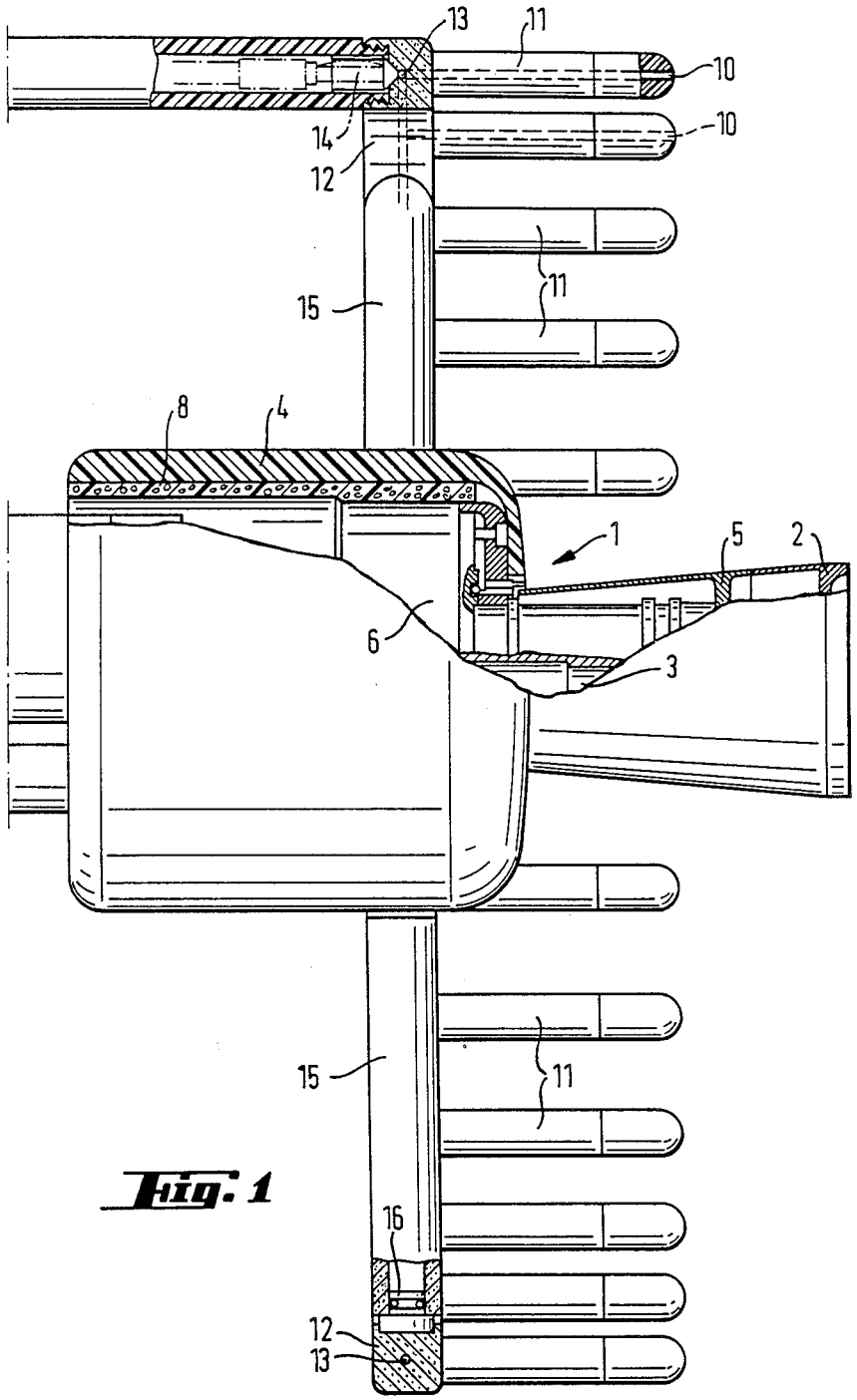
FIG. 1 is a partially sectioned side view of the preferred embodiment of the invention.

The apparatus illustrated in FIG. 1 contains a spraying device in the form of a rotary atomizer 1 of the known bell-type. A bell-plate 2 forms the spraying head and is driven at high r.p.m. preferably by an air-turbine. Along the axis of the spraying device extends a metal pipe 3. The pipe 3 carries a water-enamel or some other conductive coating material from a storage system to the bell-plate 2. All of the coating material as far as the spraying edge of the bell-plate 2 is at ground potential. Also at ground potential is the workpiece (not shown) to be coated, such as a part of a motor-vehicle body axially spaced from the bell-plate 2.

The spraying device includes an external housing 4 made of an insulating plastic which may contain a metallic internal housing 6. Extending between the bell-plate 2 and an end-face of the external housing 4 is a cover 5 which rotates with the bell-plate 2 and which may also be made of metal, like the grounded bell-plate 2. Alternatively, a cover 5 may be arranged as a separate component at the side of the bell-plate 2. Needle-shaped charging electrodes 10 are provided for charging the coating material sprayed from the spraying edge of the bell-plate 2. The electrodes 10 are arranged at uniform angular distances upon a circle concentric with the axis of the spraying device. The electrodes 10 are axially parallel with the main parts thereof embedded in finger-like projections 11, made of an insulating material, from an annular element 12 also made of insulating material. The rear ends of the electrodes 1? are connected electrically to an annular wire conductor 13 which connects all of the electrodes 10 together. The conductor 13 is completely enclosed in the interior of the annular element 12, in order to insulate the conductor 13 electrically. The electrodes 10 and the conductor 13 are connected through a high-voltage cable 14 to a high-voltage output generator. The voltage output of the generator may be typically on the order of 60 to 100 kV. The annular element 12 is connected to the spraying device by two spoke-like supports 15, which are made of an insulating material. The supports 15 may be clamped (in a manner not shown) to the external housing 4 by means of a clamping ring.

The number of charging electrodes 10 should be such that the distance between the electrodes 10 is short enough to eliminate any danger of contamination of the front face of the annular element 12 by the coating material. For example, with an electrode pitch-circle diameter of 400 mm, approximately 18 electrodes at least should be used. If a smaller or larger pitch-circle diameter is used for the electrodes 10, the possible minimal number of electrodes 10 should be reduced or increased proportionally. Thus, over a relatively large range of pitch-circle diameters around the 400 mm value of the example described herein, the distance between electrode-tips should be about 40 and 70 mm. As in the case of the exemplary dimensions mentioned above, the radial distance between the electrode-tips and the spraying edge of the bell-plate 2 should exceed twice the diameter of the spraying edge (in the case of the previous example about 70 mm). A presently preferred range of possible pitch-circle diameters of electrodes 10 amounts to about 350 to 450 mm. Also significant regarding the danger of contamination is the axial position of the electrode-tips in relation to the plane of the spraying edge. The electrode-tips are set back axially behind the spraying edge. This distance is such as to provide a useful compromise between the charging of the sprayed coating material, which improves as the distance between the plane of the spraying edge and the electrode-tips decrease, and the danger of contamination which increases at the same time. In the preferred embodiment, axially measured distances of between 25 and 60 mm, preferably about 50 mm, have been found satisfactory. Generally, the front ends of the charging electrodes 10, i.e., the electrode-tips, should be set back axially behind the plane of the spraying edge a distance equal to less than $\frac{1}{3}$ of the radially measured distance between the electrode-tips and the spraying edge.

In the prior art, self-coating of both the electrode-holding arrangement and of the external housing 4 of the atomizer has been observed regardless of an optimal number of electrodes 10 or the arrangement thereof in the manner described above. According to the subject invention, this problem is largely overcome by using a fluorocarbon resin, for example PTFE (polytetrafluorethylene), such as that marketed under the trade-name "TEFLON", for at least some of the insulated components of the apparatus. Preferably, the fluorocarbon resin is used to fabricate the external housing 4, the radial supports 15, and the stud-like or finger-like projections 11.

The radial supports 15 may consist of a tube into the open end of which the annular element 12 may be sealingly inserted with fitted radially projecting pins 16. For design and production related reasons, the annular element 12 may be made of a different plastic such as polyacetate (POM -polyoxymethylene).

It has been found expedient in the prevention of self-contamination for the outer surfaces of parts made of PTFE to be substantially continuous, i.e., free from holes, gaps, joints, etc.. The external housing 4, in particular, should be free from recesses, openings and drillings and should not contain screws or the like If fastening elements of this kind are unavoidable, they should also be made of PTFE. One reason for self-contamination observed in a hole or some other recess in the external housing 4 may possibly be due to a reduction in dielectric strength. At least where there is any danger of contamination by the sprayed coating material, the breakdown-voltage of housing 4 should amount to at least 5 kV.

There may be located between the external housing 4 and the metallic internal housing 6 a separate cover 8 made of a three-dimensional material permeable to air. For example, the separate cover 8 may comprise a porous plastic element which provides protection from condensation-water. A material suitable for this purpose is obtainable commercially under the name "Filtroplast".

The invention is not restricted to the preferred example of embodiment illustrated, i.e., comprising an insulating annular element 12 and a relatively large number of external electrodes 10. Instead, the prior art electrostatic spraying device disclosed in German OS 34 29 075, comprising individual electrodes each arranged in a support, is also suitable.

There is no explanation as yet as to why PTFE provides better protection against self-contamination than other materials. It may be due to some of those properties whereby PTFE differs from other plastics such as PP, POM, PVC and other insulating materials such as fibre-board and ceramic. For example, PTFE may provide better protection due to such factors as extremely high surface-resistance (measured according to DIN 53 482), and relatively low electro-static chargeability due to low relative permittivity and very slow discharge, i.e., chronological change in charge-distribution by reason of charge-equalization over the surface. Furthermore, PTFE absorbs practically no water and its properties are therefore not dependent upon changes in atmospheric humidity.

Radial potential-control contributes to a reduction in self-contamination. The radial-potential pattern in the vicinity of the spraying device, defined in the space between the metallic internal housing 6 and the charging electrodes 10, is approximated to the radial-potential distribution in the sprayed material. The radial potential control may also be achieved with other materials. To this end, it is desirable for the electrode-holding arrangement to consist, at least in the radial support 15 on the side racing the workpiece, of an insulating material. The surface-potential of the insulating material, when the unit is in operation, approximates in the radial direction the potential distribution in the sprayed material This can be achieved by, among other things, the surface-behavior for self-charging and charge-leakage, more particularly surface-resistance. Preferably, all parts of the electrode-holding arrangement are, at least approximately, at the same electrical potential as the paint-particles during spraying. As a rule, therefore, a radially continuous potential-control is to be preferred in the area between the atomizer housing 6 and the electrodes 10. In conjunction with this objective, the material used for tubular supports 15 may also be ceramic instead of PTFE. Other materials having a surface-resistance similar to that of ceramic, POM, or PTFE may also be used under certain circumstances.

Instead of the preferred metal material, the spraying head 2, and/or the cover 5 which rotates therewith, may at leas+in part be made of other materials suitable for the desired potential-control.

In the embodiment illustrated in FIG. 1, the previously mentioned three-dimensional porous annular cover 8 is located between the external housing 4 and the metallic internal housing 6.

Figure 2:
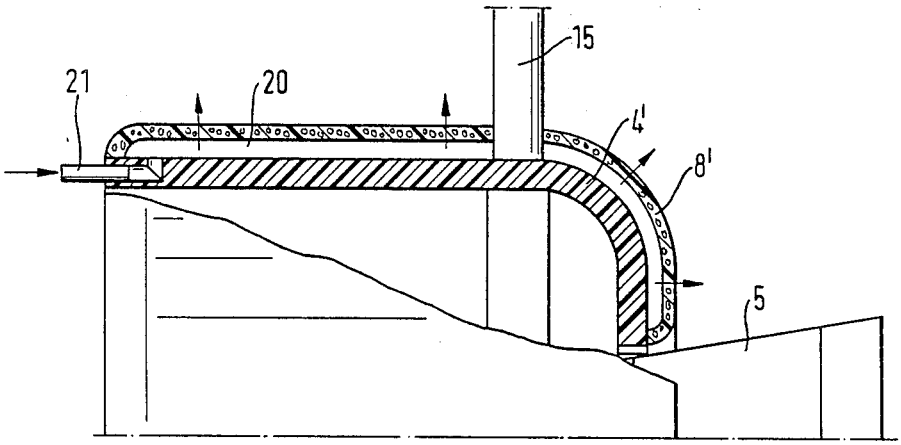
FIG. 2 is an alternative embodiment of an atomizer-housing according to the subject invention.

FIG. 2 shows an alternative embodiment, wherein a cover 8' encloses the entire exterior of an external housing 4' made of PTFE, in the manner of a hood. Between the exterior of the external housing 4' and the interior of the whole of cover 8', with the exception of the axially front and rear edges, an air-gap 20 is disposed. A line 21 extends into the air-gap 20 for the purpose of injecting air into the annular gap 20. The injected air passes to the outside of the cover 8' through the porous material. Additionally, the cover 8' may have an opening for the passage of the support 15.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. An apparatus for electrostatically coating workpieces with an electrically conductive coating material, said apparatus comprising: a spraying device having an atomizer (1), an internal housing (6) supporting said atomizer (1), said atomizer (1) including a spraying head (2) extending from said internal housing (6); a supply line (3) conducting the coating material from a storage-system to said spraying head (2), said supply line (3) and said spraying head (2) being at ground potential; charging electrodes (10) distributed about said spraying head (2) and connected to a high-voltage supply for charging the coating material and producing an electric field; an electrode-holding arrangement (11, 12, 15) made of an insulating material disposed about said internal housing (6); said apparatus characterized by including potential-control means having a surface interconnecting said internal housing (6) and said charging electrodes (10) for approximating the radial-potential pattern continuously over said surface of said potential control means to the radial-potential distribution of the coating material sprayed.

2. An apparatus as set forth in claim 1 further characterized by said internal housing (6) being disposed within an external housing (4) fabricated from an insulating material.

3. An apparatus as set forth in claim 2 further characterized by said electrode-holding arrangement (11, 12, 15) including at least one support (15) extending from said external housing (4).

4. An apparatus as set forth in claim 2, further characterized by at least one of said electrode-holding arrangement (11, 12, 15) and said external housing (4) comprising said potential-control means.

5. An apparatus as set forth in either of claims 1 or 3, wherein said electrode-holding arrangement (11, 12, 15) presents a side thereof facing in the direction of said electric field further characterized by said side of said electrode-holding arrangement (11, 12, 15) being made of an insulating material, the surface-potential of said insulating material approximating the potential-distribution in the radial direction of the material sprayed.

6. An apparatus as set forth in claim 3, further characterized by said support (15) being at least partially fabricated of ceramic.

7. An apparatus as set forth in claim 1, further characterized by said electrode-holding arrangement (11, 12, 15) including an annular element (12) disposed concentrically about said spraying head (2), said annular element (12) fabricated from a polyacetal plastic.

8. An apparatus as set forth in claim 1, further characterized by said electrode-holding arrangement (11, 12, 15) being at least partially fabricated from material having a surface-resistance similar to that of a polyacetal material.

9. An apparatus as set forth in claim 1 wherein said spraying head (2) includes a cover (5) disposed thereabout, further characterized by at least one of said spraying head (2) and said cover (5) being at least partially fabricated of a material suitable for potential-control.

10. An apparatus as set forth in claim 1 further characterized by said charging electrodes (10) being generally needle-shaped and having exposed front ends distributed radially about said spraying head (2).

11. An apparatus as set forth in claim 1 further characterized by said electrode-holding arrangement (11, 12, 15) being at least partially fabricated from material having a surface-resistance similar to that of a ceramic material.

12. A method for electrostatically coating workpieces with an electrically conductive coating material, comprising the steps of: electrically grounding an atomizer (1); discharging the coating material from the atomizer (1) with a predominantly radial component of movement; supporting charging electrodes (10) from the atomizer (1) at a radially outward spacing; electrically charging the coating material sprayed from the atomizer (1) by corona discharge to form a radial potential electrical charge distribution in the coating material having the highest electrical potential proximate the electrodes (10) and the lowest electrical potential proximate the grounded atomizer (1); and characterized by including the step of approximating the radial potential pattern over a continuous surface interconnecting the atomizer (1) and the electrodes (10) to the radial potential electrical charge distribution in the coating material sprayed.

13. A method as set forth in claim 12 further characterized by covering at least a portion of the electrodes (10) and atomizer (1) with an insulating material having a surface potential approximating the potential distribution in the radial direction of the material sprayed.

14. A method as set forth in claim 13 further characterized by rotating a spraying head (2) of the atomizer (1) to discharge the coating material in the radial direction.

15. A method as set forth in claim 14 further characterized by moving a stream of air through an air-gap (20) disposed about an external housing (4') of the atomizer (1).

* * * * *